US011246205B1

(12) United States Patent
Tay et al.

(10) Patent No.: US 11,246,205 B1
(45) Date of Patent: Feb. 8, 2022

(54) SYSTEM AND METHOD OF MONITORING ACTIVITY IN AN ENCLOSED ENVIRONMENT

(71) Applicant: ILLUMINATING ASIA SG PTE. LTD., Singapore (SG)

(72) Inventors: Stanley Wee King Tay, Singapore (SG); Ram Jeet Singh, Singapore (SG)

(73) Assignee: ILLUMINATING ASIA SG PTE. LTD., Singapore (SG)

( * ) Notice: Subject to any disclaimer, the term of this patent is extended or adjusted under 35 U.S.C. 154(b) by 0 days.

(21) Appl. No.: 17/183,460

(22) Filed: Feb. 24, 2021

(30) Foreign Application Priority Data

Jul. 17, 2020 (SG) ..... 10202006833R

(51) Int. Cl.

| | |
|---|---|
| ***H05B 47/13*** | (2020.01) |
| ***H05B 47/125*** | (2020.01) |
| ***H05B 47/19*** | (2020.01) |
| ***F21V 23/04*** | (2006.01) |
| ***G21G 4/02*** | (2006.01) |
| *F21Y 115/10* | (2016.01) |

(52) U.S. Cl.
CPC ..... *H05B 47/13* (2020.01); *F21V 23/0478* (2013.01); *G21G 4/02* (2013.01); *H05B 47/125* (2020.01); *H05B 47/19* (2020.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 9,723,693 | B1 * | 8/2017 | Megginson | H04N 5/23218 |
| 2014/0374602 | A1 * | 12/2014 | Falcone | H01L 31/16 250/341.1 |
| 2016/0253740 | A1 | 9/2016 | Goulart | |
| 2018/0220506 | A1 * | 8/2018 | Sadwick | H05B 45/10 |
| 2019/0309974 | A1 * | 10/2019 | Kostrun | G06K 9/00771 |

FOREIGN PATENT DOCUMENTS

| | | | |
|---|---|---|---|
| EP | 3069076 | A1 | 9/2016 |

* cited by examiner

*Primary Examiner* — Dedei K Hammond
(74) *Attorney, Agent, or Firm* — JCIP; Joseph G. Chu; Jeremy I. Maynard

(57) ABSTRACT

The present invention discloses a lighting system for monitoring human activity within an enclosed environment. The system comprises one or more light fixtures including a thermal sensor housed within a sensor housing coupled to each light fixture, wherein the thermal sensor is communicatively coupled to the light fixture and configured to capture a plurality of thermal images indicative of human activity surrounding a fixture within the enclosed environment, wherein each thermal image includes a grid having a plurality of pixels corresponding to a section of the enclosed environment, a processor configured to receive the plurality of thermal images from the thermal sensor, wherein the processor is in data communication with the thermal sensor and the light fixture and a wireless transceiver communicatively coupled to the processor.

17 Claims, 6 Drawing Sheets

SYSTEM AND METHOD OF MONITORING ACTIVITY IN AN ENCLOSED ENVIRONMENT

CROSS-REFERENCE TO RELATED APPLICATION

The present application claims the right of priority to Singapore Application No. 10202006833R having a filing date of Jul. 17, 2020, the entire contents of which are hereby incorporated herein by reference.

TECHNICAL FIELD

The present disclosure relates to activity monitoring. More particularly, the present disclosure relates to a system and method for monitoring and tracking human activity with minimal privacy concerns within an enclosed environment.

BACKGROUND

The following discussion of the background to the invention is intended to facilitate an understanding of the present invention. However, it should be appreciated that the discussion is not an acknowledgment or admission that any of the material referred to was published, known or part of the common general knowledge in any jurisdiction as at the priority date of the application.

Effective management of the layout of an enclosed environment and the product placement within the enclosed environment is both an art and a science, requiring creativity, psychological insight, testing, and continuous monitoring. Common means for monitoring human activity include networked sensors and/or video cameras mounted within the enclosed environment. Frequently used sensors include motion sensors and infrared sensors. Use of infrared sensor data in detecting stationary presence of humans is disclosed, for instance, in the European Patent Application Publication No. EP3069076A1 entitled "Human Presence Detection Techniques" published on 21 Sep. 2016. Bluetooth brand beacons configured to interact with customer smart phones can also be used to monitor customer activity.

Video camera footage can be analysed manually by retail store staff or analysed automatically by computer-implemented systems. U.S. Patent Application Publication No. US2016/0253740A1, entitled "System and Methods for Generating and Using a Heat Map of a Retail Location to Reduce Overcrowding" published 1 Sep. 2016, for instance, discloses use of video cameras and/or motion sensors to generate heat maps of customer activity. A grouping of heat spots in the heat map can indicate a high level of customer interest in a specific product or a traffic choke point in the retail space layout.

With regards to US2016/0253740A1, the absence of a heat spot in an area of the enclosed environment can, alternatively, indicate a blockage in the enclosed environment layout or a lack of interest from customers in a group of product items displayed in that area of the retail space. Such feedback is useful in modifying the space layout and/or the product placement strategy. Video footage, however, requires significant image processing and memory during its computer-implemented analysis.

A challenge arises also with the use of video cameras and motion sensors in regard to their optimal placement within the enclosed environment. Full coverage of an enclosed environment can be prohibitively expensive and/or so obtrusive as to impact customer behavior. Additionally, while the use of conventional video cameras or closed circuit television (CCTV) cameras is required by owners to record and monitor activities remotely or for prevention of criminal activity or shaping positive behavioral traits, these conventional video monitoring poses significant privacy concerns. For example, privacy cannot be compromised in enclosed spaces such as bathrooms, changing rooms, hotel rooms, nursing homes, or healthcare facilities. Further, video cameras and sensors require a continuous power source for daily function. And a high degree of resolution in the heat map may be needed to distinguish the customer interest between different product item groupings located in adjacent fixtures.

Therefore what is needed in the art is a low cost yet accurate system and method for monitoring human traffic activity within an enclosed environment. Such a system and method would benefit from a proper vantage point from which to view human traffic activity at high resolution. Such a system and method would benefit also if unobtrusive, so as to not impact behavior of the human traffic during their perusal of product items in the enclosed environment. Preferably such a system and method would also enable robust heat mapping of human traffic activity for specific time windows and for specific product items without an excessive demand for data processing and memory during its computer-implemented analysis.

The present invention attempts to overcome at least in part some of the aforementioned disadvantages and to provide a system and method for monitoring and tracking real-time activity within an enclosed environment as described herein.

SUMMARY OF THE INVENTION

Throughout this document, unless otherwise indicated to the contrary, the terms "comprising", "consisting of", and the like, are to be construed as non-exhaustive, or in other words, as meaning "including, but not limited to".

Various embodiments of the present invention disclose methods and systems for monitoring human activity in a variety of enclosed environments. Such methods and systems may employ light fixtures that may be LED or non-LED based, or a combination of both that may be modularly design for its purpose according to the present invention.

An aspect of the present invention discloses a method for monitoring human activity within an enclosed environment. The method comprises the steps of: capturing, by a thermal sensor communicatively coupled to a light fixture substantially directed on a section of the enclosed environment, a plurality of thermal images indicative of human activity surrounding a fixture within the enclosed environment, wherein each thermal image includes a grid having a plurality of pixels corresponding to a section of the enclosed environment and transmitting, by a wireless transceiver communicatively coupled with the thermal sensor, the plurality of thermal images to a server. The method further determines, by the server, a human activity pattern of the section of the enclosed environment based on the plurality of thermal images, wherein the human activity pattern corresponds to a group of pixels defining a heat signature associated with a presence of one or more persons within the section of the enclosed environment. The method further includes generating, by the server, a graphical representation of the human activity pattern of the enclosed environment over a predetermined period of time, wherein the graphical representation is configured for display on a graphical user interface of a user device.

In an embodiment of the invention, the method further aggregates, by the server, a plurality of second thermal images obtained by a second thermal sensor communicatively coupled to a second light fixture with the plurality of first thermal images obtained from the first thermal sensor for identifying the human activity pattern of the enclosed environment.

In an embodiment of the invention, the method further comprises the step of: transmitting, by an access management application, an alert notification to the user device when the human activity pattern determined by the server indicates a potential incident, wherein the potential incident is associated with a lack of movement of the group of pixels defining the heat signature associated with the presence of one or more persons over a predetermined period of time.

In other embodiments of the invention, the enclosed environment includes any one selected from the group consisting of: a retail store, a hotel, a building, an office, a nursing home, a healthcare facility and a hospital.

In other embodiments of the invention, the heat signature is obtained by measuring the apparent temperature difference between the ambient temperature and the one or more persons so as to cause the group of pixels to provide a contrast with the plurality of pixels within the grid.

In other embodiments of the invention, the group of pixels defining the heat signature corresponds to a top view of the head of one or more persons.

In other embodiments of the invention, the group of pixels defining the heat signature corresponds to a top view of the body mass of one or more persons.

In an embodiment of the invention, the human activity pattern further includes a dwell time of the one or more persons, wherein the dwell time is based on the non-movement of the group of pixels defining the heat signature over a predetermined time period within the section of the enclosed environment.

In other embodiments of the invention, the human activity pattern further includes a navigation pattern of the one or more persons, wherein the navigation pattern is based on a movement of the heat signature from the group of pixels to a second group of pixels over a predetermined time period within the section of the enclosed environment.

In other embodiments of the invention, the grid further includes a coordinate system for identifying the group of pixels within the enclosed environment, wherein the coordinate system includes an x-coordinate axis and a y-coordinate axis, each of which is configured to locate the heat signature of the group of pixels.

In a second aspect of the present invention, there is provided a light fixture for monitoring human activity within an enclosed environment, the light fixture comprising a light fixture housing for housing a lighting element configured for projecting light downwards on a section of the enclosed environment, a thermal sensor housed within a sensor housing coupled to the light fixture housing, the thermal sensor configured to capture a plurality of thermal images indicative of human activity surrounding a fixture within the enclosed environment, wherein each thermal image includes a grid having a plurality of pixels corresponding to a section of the enclosed environment, a processor configured to receive the plurality of thermal images from the thermal sensor, wherein the processor is in data communication with the thermal sensor and the light fixture, and a wireless transceiver communicatively coupled to the processor and configured to transmit the plurality of thermal images to a server, wherein the server is configured to determine a human activity pattern of the section of the enclosed environment, and the human activity pattern corresponds to a group of pixels defining a heat signature associated with a presence of one or more persons within the section of the enclosed environment.

In an embodiment of the invention, the light fixture further comprises a power source electrically connected to the thermal sensor, wherein the power source is configured to provide power supply to the thermal sensor when the power to the light fixture is turned off.

In other embodiments of the invention, the enclosed environment includes any one selected from the group consisting of: a retail store, a hotel, a building, an office, a nursing home, a healthcare facility and a hospital.

In other embodiments of the invention, the heat signature is obtained by measuring the apparent temperature difference between the ambient temperature and the one or more persons so as to cause the group of pixels to provide a contrast with the plurality of pixels within the grid.

In other embodiments of the invention, the group of pixels defining the heat signature corresponds to a top view of the head of one or more persons.

In other embodiments of the invention, the human activity pattern further includes a dwell time of the one or more persons, wherein the dwell time is based on the non-movement of the group of pixels defining the heat signature over a predetermined time period within the section of the enclosed environment.

In other embodiments of the invention, the human activity pattern further includes a navigation pattern of the one or more persons, wherein the navigation pattern is based on a movement of the heat signature from the group of pixels to a second group of pixels over a predetermined time period within the section of the enclosed environment.

In other embodiments of the invention, the grid further includes a coordinate system for identifying the group of pixels within the enclosed environment, wherein the coordinate system includes an x-coordinate axis and a y-coordinate axis, each of which is configured to locate the heat signature of the group of pixels.

In a third aspect of the present invention, there is provided a lighting system for monitoring human activity within an enclosed environment, comprising a server configured for wireless communication with the plurality of light fixtures, wherein the server is configured to determine a human activity pattern within the enclosed environment, and the human activity pattern corresponds to a group of pixels defining a heat signature associated with a presence of one or more persons within the enclosed environment; and a plurality of light fixtures mounted within the enclosed environment and configured for wireless connection with one another and to the server via a network. Each light fixture comprises a thermal sensor housed within a sensor housing coupled to the light fixture, wherein the thermal sensor is communicatively coupled to the light fixture and configured to capture a plurality of thermal images indicative of human activity surrounding a fixture within the enclosed environment, wherein each thermal image includes a grid having a plurality of pixels corresponding to a section of the enclosed environment, a processor configured to receive the plurality of thermal images from the thermal sensor, wherein the processor is in data communication with the thermal sensor and the light fixture and a wireless transceiver communicatively coupled to the processor.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. The dimensions of the various features or elements may be arbitrarily expanded or reduced for clarity. In the following description, various embodiments of the invention are described with reference to the following drawings, in which.

DETAILED DESCRIPTION

In the following detailed description, reference is made to the accompanying drawings, which form a part hereof. The illustrative embodiments described in the detailed description, drawings and claims are not meant to be limiting. Other embodiments can be utilized, and other changes can be made, without departing from the spirit or scope of the subject matter presented herein. Unless specified otherwise, the terms "comprising," "comprise," "including" and "include" used herein, and grammatical variants thereof, are intended to represent "open" or "inclusive" language such that they include recited elements but also permit inclusion of additional, un-recited elements.

As used herein, the software and hardware of a "server" may be implemented within a single stand-alone computer, a stand-alone server, multiple dedicated servers, and/or a virtual server running on a larger network of servers and/or a cloud-based service. As used herein, a database may store data to and access data from a single stand-alone computer, a data server, multiple dedicated data servers, a cloud-based service, and/or a virtual server running on a network of servers.

As used herein, a user interface may be implemented by a monitor with a display window, a keyboard, a mouse, a touch screen, a touch pad, and/or similarly directed means. The user interface may be configured by a laptop, a smart phone, a tablet, a single stand-alone computer, a stand-alone server, multiple dedicated servers, and/or a virtual server running on a larger network of servers and/or a cloud-based service.

In order that the invention may be readily understood and put into practical effect, particular embodiments will now be described by way of examples and not limitations, and with reference to the figures. It will be understood that any property described herein for a specific product may also hold for any product described herein. It will be understood that any property described herein for a specific method may also hold for any method described herein. Furthermore, it will be understood that for any device or article or method described herein, not necessarily all the components or steps described must be enclosed in the product or device or method, but only some (but not all) components or steps may be enclosed.

Figure 1:
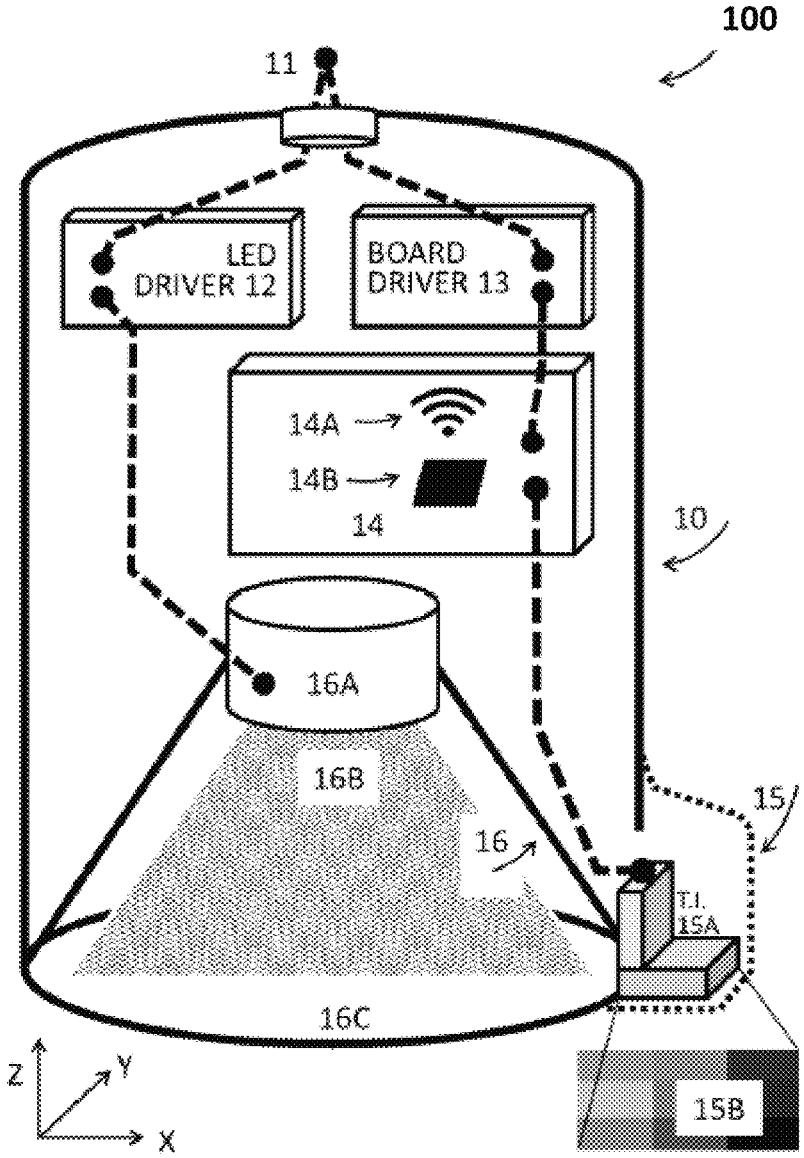
FIG. 1 is a block diagram of a light fixture according to an embodiment of the invention.

FIG. 1 is a diagram illustrating a light fixture 100 according to an embodiment of the invention. The light fixture 100 includes a light fixture housing 10 for housing a lighting element 16A, a processor 14 that is in electrical connection with the lighting element 16A, a thermal sensor 15A, a light fixture driver 12 and a board driver 13. In some embodiments, the light fixture housing 10 includes a light cone 16B for projecting light downwards into an enclosed environment. In some embodiments, the light fixture driver 12 and the board driver 13 are in electrical connection with a connector 11 which provides electricity or other energy to the electronic components and/or a data connection to the processor for communication between the processor and components that are coupled to the connector 11. The processor 14 includes a wireless transceiver 14A configured for connecting to a network for transmitting and receiving data from a server or user device via wireless communication protocols.

The wireless transceiver 14A is configured to transmit and receive data wirelessly via wireless communication protocols, for example, short-range or long-range wireless communication protocols. In some embodiments, the wireless transceiver 14A is intended for transmitting and receiving data for performing functions associated with the light fixture or the thermal sensor. In some embodiments, the functions may include modular or reconfiguration of a single or a plurality of light fixtures that are wirelessly connected to one another via a network and may be varied to accommodate desired needs and situations. In some embodiments, the wireless transceiver is configured to transmit a plurality of thermal images captured by a thermal sensor to a server via a network, details of which will be explained hereinafter.

The processor 14 may be any data processing device, such as a microprocessor. Examples of processors include microprocessors, microcontrollers, graphics processing units (GPUs), central processing units (CPUs), application processors, digital signal processors (DSPs), reduced instruction set computing (RISC) processors, systems on a chip (SoC), baseband processors, field programmable gate arrays (FPGAs), programmable logic devices (PLDs), state machines, gated logic, discrete hardware circuits, and other suitable hardware configured to perform the various functionality described throughout this disclosure and capable of receiving and manipulating input and output signals consistent with the principles of the invention. One or more processors in the processing system may execute software. Software shall be construed broadly to mean instructions, instruction sets, code, code segments, program code, programs, subprograms, software components, applications, software applications, software packages, routines, subroutines, objects, executables, threads of execution, procedures, functions, etc., whether referred to as software, firmware, middleware, microcode, hardware description language, or otherwise. The processor 14 includes input/output circuitry including any suitable analog/digital and digital/analog circuitry, and other signal processing circuitry for transforming signals from the processor 14 into signals for the light fixture 100 and the transceiver 14B, as well as for transforming signals from the transceiver 14B into signals for the processor 14.

In some embodiments, the connector 11 is in electrical connection with a powerline which is a direct current source. In other embodiments, the power connector 11 is in electrical connection with a powerline. The powerline may be an alternating current source. In some embodiments, the connector 11 is in electrical connection with: (i) an light fixture driver 12 in electrical connection with the light fixture 16A; and (ii) a processor 14.

In some embodiments, the lighting element 16A may be any known light source, including an LED light, programmable LED array, incandescent lamp, floodlight, high-voltage spotlight, track light, fluorescent light, neon light, halogen light, or any other illumination source. LED lighting elements are particularly well suited for such networks because they can be configured to be responsive to electronic signals, including digital data protocols.

It is to be appreciated by a person skilled in the art that a thermal sensor is known in the art and may include a thermographic camera, infrared sensor, infrared camera, thermal imaging camera, thermal imager and is a device that creates an image using infrared radiation, similar to a common camera that forms an image using visible light. Instead of the 400-700 nanometer range of visible light camera, infrared cameras are sensitive to wavelengths from about 1,000 nm to about 14,000 nm. It should be understood that the present principles may be applied to other types of imaging devices, but infrared is particularly contemplated for the present invention because human bodies inherently emit detectable levels of infrared radiation relative to the surrounding environment. Limiting the thermal sensor to infrared radiation serves to prevent potential privacy infringement that might arise from recording visible light information.

In some embodiments, the thermal sensor 15A is housed within a sensor housing 15 mounted on an outer surface of the light fixture housing 10. In one embodiment, the sensor housing 15 can be assisted also with an "L" shaped pin connector. The sensor housing 15 has an advantage of not interfering with the original design of the light fixture 100, as additional real estate is obtained outside the light fixture 10. Additionally, any impact of heat from the light fixture source on the infrared temperature readings of the thermal sensor 15A is minimized In some embodiments, the sensor housing 15 may be integrated or housed within the light fixture housing 10. In some embodiments, the thermal sensor 15A is directed downwards of the light fixture housing 10 into the enclosed environment.

The light fixture 10 includes a power source that provides independent power supply to the thermal sensor 15A. The power source can be a battery energy source, for example, a rechargeable battery. In order for the thermal sensor to provide real-time continuous monitoring of the enclosed space at all times, an independent power supply is provided to the thermal sensor 15A even at times when the light fixture has been switched off, for example, at night or when the enclosed space is no longer operating for the day. The power supply is independent of the power supply that is provided to the light fixture. In some embodiments, the power source is configured to be activated in the instance the light fixture is switched off and configured to be deactivated in the instance the light fixture is switched on. In some embodiments, the power source is configured to be recharged by the power source of the light fixture when the light fixture is turned on, to avoid frequent power source or battery replacement. In some embodiments, the thermal sensor continues to monitor the enclosed space even when the light fixture has been switched off, for example, in bathrooms, nursing homes or healthcare facilities where non-activity for a prolonged period of time may indicate an occurrence of an incident.

Figure 2:
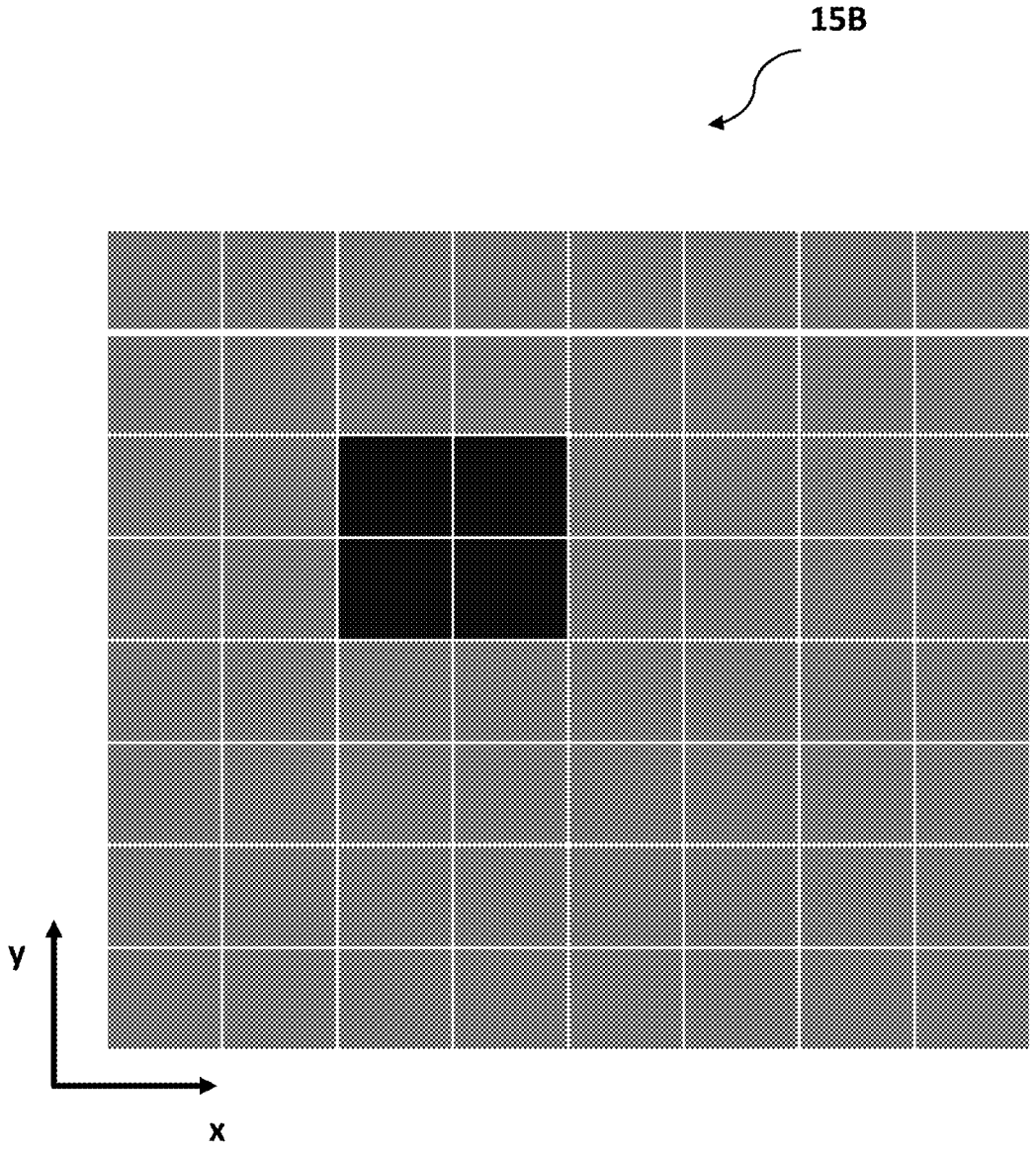
FIG. 2 illustrates a representation of a thermal image according to an embodiment of the invention.

FIG. 2 illustrates a grid corresponding to a floor plan of the enclosed environment that is associated with a thermal image captured by a thermal sensor. As the thermal sensor is downwardly projecting on the enclosed environment, the grid is therefore substantially on the same plane as the enclosed environment or floor plan. The thermal sensor 15A is configured to capture a plurality of thermal images or video of the enclosed environment 15B. Each thermal image includes having a plurality of pixels corresponding to a section of the enclosed environment. that includes a plurality of temperature readings (illustrated in shades of gray in the thermal image 15B) and transmit the temperature readings to the processor 14. The plane of the enclosed space can be defined such that an x-axis and a y-axis are parallel with a floor of the space. In order to define the physical location of a person and fixtures within the floor space, a thermal image captured by the thermal sensor is defined by a predetermined number of pixels. A user-defined coordinate system can be defined to identify humans and objects within the floor space. In some embodiments, the physical locations within the space can be described using (x, y) coordinates in the grid. In some embodiments, the grid comprises an 8×8 grid that includes a total of 64 pixels. In this configuration, the thermal image records a heat signature of a person against the floor space with which it is viewed from a light fixture directed downwards. The heat signature is obtained by measuring the apparent temperature difference between the ambient or background temperature and the object of interest. In some embodiments, the heat signature of a person, as viewed from a light fixture, is a person's head or body mass of a person. Depending on the distance of the person's head or body mass from the light fixture, which can be calibrated and determined in advance, a person's head or body mass can be representative of a predetermined number of pixels on the grid. In this example, a person that is standing under the light fixture will have a heat signature that occupies 4 pixels. If the light fixture is installed at a greater distance from the floor space, a person may have a heat signature that occupies a lesser number of pixels. If the person moves away from his current location, then the heat signature will move to a new location within the grid. In some embodiments, each thermal image includes a grid including an 8×8 grid of 64 temperature readings. In some embodiments, each thermal image 15B includes a table of 64 temperature measurements. For example, an off-the-shelf component for such an application is the Panasonic brand AMG8833 IR thermal sensor. This thermal sensor includes an 8×8 grid and provides an array of temperature measurement readings every second in a table of 64 entries.

In some embodiments, multiple light fixtures can be configured such that they are wirelessly connected to one another via a network and may be varied to accommodate the desired needs and situations. For example, multiple light fixtures are configured for installation and wirelessly communicable with one another in the enclosed environment so that the entire enclosed environment can be covered by the light fixtures. This ensures that the thermal sensors have coverage of the entire enclosed environment. In some embodiments, multiple light fixtures are configured for installation and wirelessly communicable with one another in the enclosed environment so that only a section of the enclosed environment is covered by these light fixtures. For example, if a retailer would like to monitor the human activity around a display fixture in a section of the store, light fixtures can be installed around the display fixture so that human activity around the display fixture can be monitored and tracked by the thermal sensors that are communicatively coupled to the light fixtures. In some embodiments, the enclosed environment may include, but not limited to, a retail store, a hotel, a building, an office, a nursing home, a healthcare facility and a hospital.

In some embodiments, the thermal sensor 15A is in electrical connection with the board driver 13 indirectly through its connection with the processor 14. While illustrated as shades of gray, the infrared sensor grid provides a matrix of numerical temperature readings. In some embodiments, this matrix can be easily adapted to statistical analysis algorithms of matrix data, such as a moving average convergence divergence (MACD) analysis.

A thermal sensor often has a modest operating temperature range in comparison with other solid state electronic devices. For example, the Panasonic brand AMG8833, has an operating temperature range of 0 to 80 degrees Celsius. Given this relatively low operating temperature range, a light fixture including a lighting element 16A, for example, an LED array, is the most preferable lighting source due to its low surface temperature (typically in the range of 20 to 35 degrees Celsius). In some embodiments, a compact fluorescent bulb can also be utilized which has a surface temperature in the general range of 30 to 50 degrees Celsius during operation. Incandescent and halogen bulbs are not preferred, as they have surface temperatures exceeding 150 degrees Celsius during operation, which could impact performance of an infrared sensor grid or require significant insulation of the infrared sensor grid within the light fixture 100. In some embodiments, the light fixture 100 with lighting element 16A are composed of thin solid state surface mounted devices. The lighting element 16A can also be replaced with a single Chip-on-Board ("COB") device or other LED light source device.

It is envisaged by a person skilled in the art that in some embodiments, the processor 14 can be integrated as a single entity unit although they are shown separately. For example, the processor can be integrated with the light fixture driver 12, the board driver 13, the microprocessor 14B, and the wireless transceiver 14A. In further embodiments, the processor 14 may include the lighting element 16A and/or the thermal sensor 15A. The light fixture driver 12 and board driver 13 may also be implemented on a single integrated power chip. E.g., the various components of the light fixture 100 can be integrated together (or some intentionally not integrated together) based on manufacturing costs, quality control factors, and form factors for the light fixture 100.

The light fixture 100 is configured to project a light downward into the enclosed environment 20 through the proximate face 16C of the light fixture housing 10. The thermal sensor 15A is directed downward of the lamp fixture housing 10 and configured to capture a plurality of thermal images 15B indicative of human activity around a fixture in the enclosed environment 20. In some embodiments, each thermal image 15B includes a plurality of temperature readings captured by the infrared sensor grid. The processor 14 is configured to receive each of the thermal images 15B captured by the thermal sensor 15A. Each light fixture 100 is configured to transmit the thermal images 15B via the transceiver 14A communicatively coupled to the processor 14. The transceiver 14A transmits the temperature readings of each thermal image 15B via the network to a gateway device 21 located within the enclosed environment 20. The transmission of each thermal image 15B is paired with an image timestamp for the thermal image 15B and a light fixture identifier of the light fixture 100 transmitting the thermal image 15B.

In some embodiments, each light fixture 100 is in electrical connection with a powerline through the connector 11; and each wireless transceiver 14A is a powerline network adapter in data communication with the gateway 21 through the powerline. In such an embodiment, the thermal images 15B data is transmitted through the powerline from each light fixture 100 to a powerline network receiver which routes data packets received through the powerline to the server 29 through the gateway 21.

Figure 3:
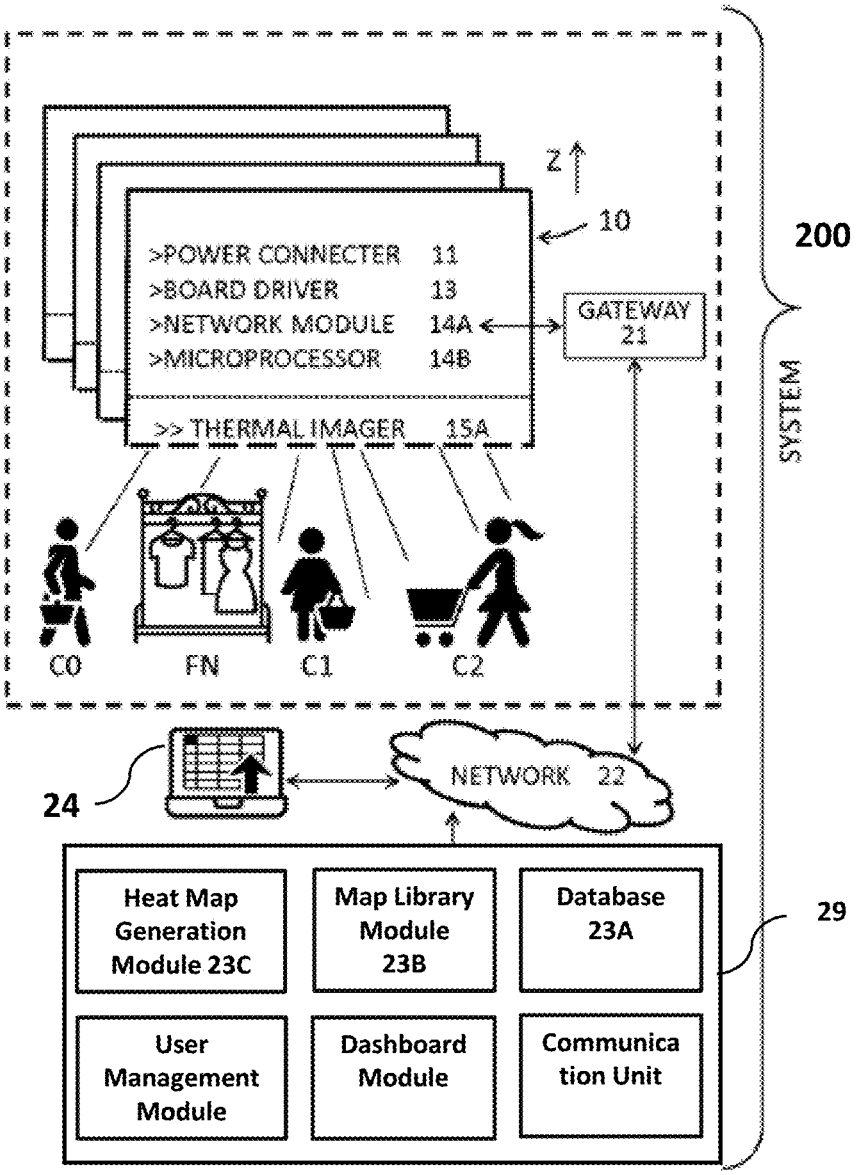
FIG. 3 is a high-level block diagram of a lighting system for monitoring human activity in an enclosed environment according to an embodiment of the invention.

FIG. 3 is a high-level block diagram illustrating a system 200 for monitoring human activity in an enclosed environment 20 according to an embodiment of the invention. The system 200 may operate as a platform to support the receiving, transmitting, analyzing and determining of thermal sensor data available throughout a network, and to support application of the thermal sensor data to control and modify the enclosed environment. A plurality of light fixtures 100 are connected to a gateway device 21 via a network 22. In some embodiments, the plurality of light fixtures is connected directly to a server 29 via the network 22. In various embodiments, the wireless transceiver 14A of each light fixture 100 can communicate data including but not limited to thermal images or thermal videos via any suitable wireless communication protocols. For example, the wireless communication protocols can include a cellular network, a short-range wireless network, a wireless local area network (WLAN), a low-power Wide Area Network (LP-WAN), etc. The cellular network can be any of various types, such as code division multiple access (CDMA), time division multiple access (TDMA), global system for mobile communication (GSM), long term evolution (LTE), 3G, 4G, 5G, etc. The short-range wireless network can also be any of various types, such as Bluetooth, Bluetooth Low Energy (BLE), near field communication (NFC) etc.

The enclosed environment 20 includes a floor space that may include one or more products displayed on a first fixture FN. One or more light fixtures 100 are directed downward from the light fixtures 100 with a line-of-sight to the human traffic traversing the first fixture. In some embodiments, the light fixtures 100 may be employed for any of a variety of diverse functions. For example, the light fixtures may be employed in a building, such as a home, office, hotel, nursing home, healthcare facility or hospital, as overhead light fixtures as described herein. Additionally or alternatively, the light fixtures may be employed in displays, in lighted floors or wall panels, cove lighting, or in any other desired configuration. Other configurations and applications of light fixtures capable of the functions below or other functions are considered to fall within the boundaries of the present invention. In some embodiments, the fixture FN can be a bed in a hospital or nursing home or healthcare facility, or a fixture within a bathroom or shower room, any suitable fixture within offices, homes, hotels, that can be monitored.

In some embodiments, the gateway 21 is in data communication with a network 22. The network 22 is in data communication with a user device 24 and a server 29. The server 29 includes an access management application that includes but is not limited to, a plurality of modules such as a map library module 23B, a database 23A for storing historical thermal maps, a heat map generation module 23C, a map analysis module 23E and a communication unit (not shown). Each of the modules of the access management application will be explained in detail hereinafter.

The communication unit is a component that allows the server 29 to communicate with another device, for example, with the processors of the thermal sensors, the light fixtures, the user device via the network 22. The communication unit can include one or more wireless transceivers for performing wireless communication and/or one or more communication ports for performing wired communication.

In some embodiments, the server 29 is communicatively coupled with the network 22 and is configured to receive the thermal images 15B from each thermal sensor coupled to each light fixture 100. The gateway device 21 is in data communication with a network 22. The server 29 is configured to store each thermal image 15B in a database 23A. The thermal images 15B are stored corresponding to a thermal record, which includes: (1) human activity patterns associated with the temperature readings captured by the thermal sensor 15B; (2) the image timestamp of each thermal image 15B; and (3) the light fixture identifier corresponding to the light fixture 100 transmitting the thermal image 15B.

Figure 4:
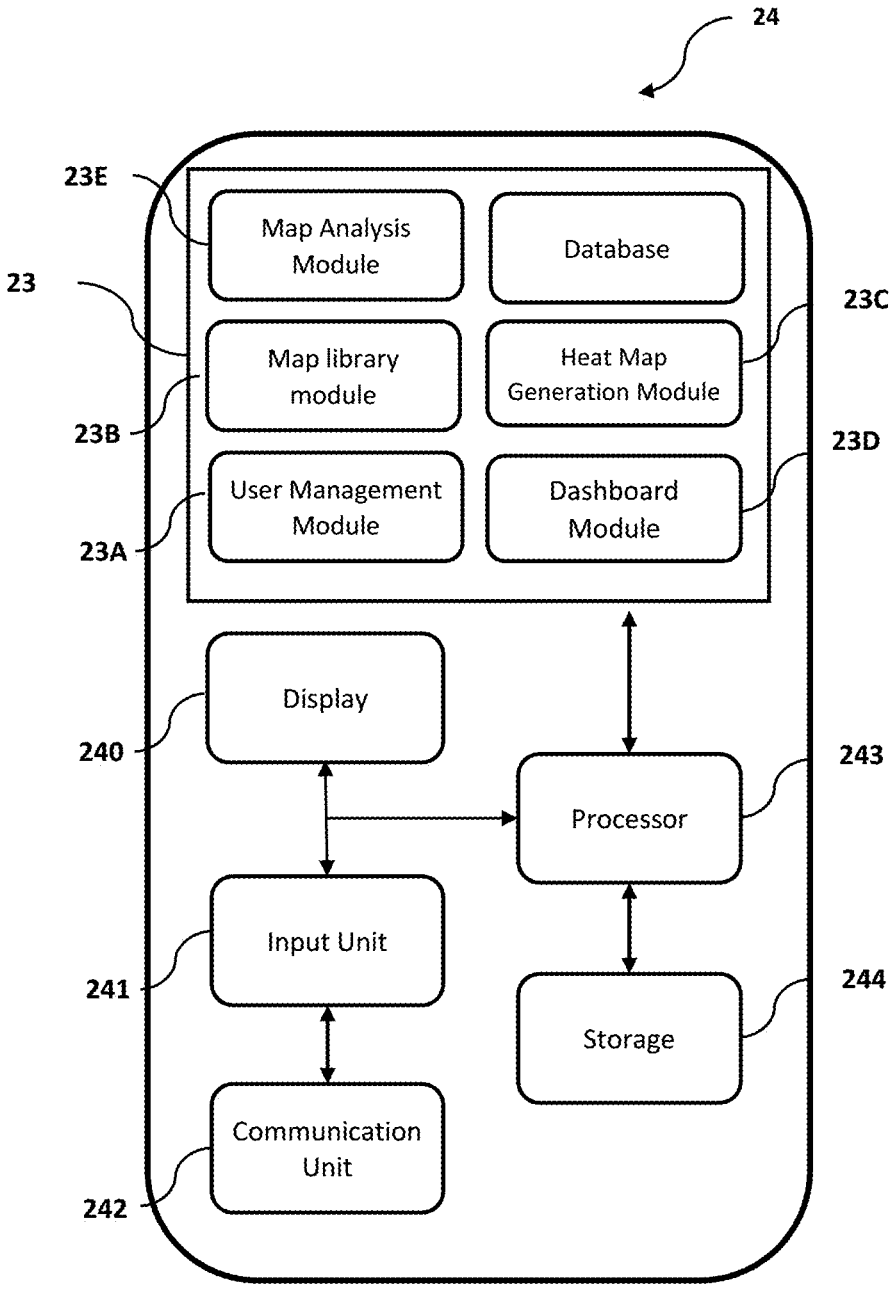
FIG. 4 is a high-level block diagram of a user device and its components according to an embodiment of the invention.

FIG. 4 is a high-level block diagram illustrating a user device 24 that may include an access management application 23 operable on the user device. The user device 24 includes a display 240, a processor 243, an input unit 241, a communication unit 242, and a storage 244. In some embodiments, any other suitable component, including but not limited to a system bus or a controller (not shown), may also be included in the user device. In some embodiments, a mobile operating system (e.g., iOS™, Android™, Windows Phone™, etc.) and one or more applications (not shown), for example, the access management application 23, may be loaded into the storage in order to be executed by the processor 243. The applications may include a browser or any other suitable mobile apps for receiving information relating to the access management application 110. As appreciated by a person skilled in the art, user interactions with the information stream may be achieved via the I/O devices (not shown) and provided to the processor and/or other components of the system 200 via the network 22.

The access management application 23 can be installed on the user device 24 or accessible on a user device 24 for generating the heat maps. The access management application 23 may be used by retail, building management, or healthcare facility operators such as department stores, supermarkets, commercial buildings, office operators, nursing homes or healthcare facilities. The access management application 23 may include but not limited to, the map library module 23B, the heat map generation module 23C, a map analysis module 23E, a user management module and a dashboard module. The access management application is accessible by one or more users via a website or mobile device application on a user device. A mobile or a web application can be a mobile or a web application that runs and be executed on, for example, on the user device. The user device 24 may be a computer, laptop, handheld computer, mobile communication device, smartphone, tablet, or any other suitable device.

The display 240 and the input unit 241 can be a single entity although it is shown separately. The input unit 241 is configured to receive input alphanumeric information and various input signals from the user to configure settings for the generation of heat maps which may include configuration of the light fixtures, products and maps. In some embodiments, the input unit 241 may include a touch screen, a touch pad, a remote controller device that is capable of receiving an input. In some embodiments, the input unit 241 may integrated with the display.

In some embodiments, the access management application 23 includes a map analysis module 23E configured to identify a desired region of the enclosed environment and to analyze the heat signature defined by a group of pixels associated with a presence of one or more persons within the desired region of the enclosed environment. The map analysis module 23E aggregates thermal images obtained from multiple thermal sensors, each of which is coupled to a light fixture and in wireless communication with one another via a network, and analyzes the aggregated thermal images for identifying the human activity pattern of the enclosed environment. For example, the human activity pattern detected includes a dwell time of one or more persons. In some embodiments, the non-movement of a group of pixels defining the heat signature over a predetermined time period within the section of the enclosed environment is indicative of the dwell time. In some embodiments, the dwell time of a person can be indicative of a potential emergency situation. For example, in a bathroom, a dwell time of an inordinate amount of time within a bathroom cubicle can indicate a potential life-threatening situation which requires emergency attention. In other embodiments, the human activity pattern includes a navigation pattern of one or more persons. For example, a movement of the heat signature from a group of pixels to a different set of pixels within the grid over a predetermined time period within the section of the enclosed environment is indicative of the directional movement of one or more persons within the enclosed environment. In other embodiments, the human activity pattern includes tracking the speed, velocity and/or acceleration of one or more persons based on how fast or slow the movement of the heat signature from a group of pixels to a different set of pixels within the grid over a predetermined time period.

The map library module 23B includes one or more floor plans for the enclosed environment 20 and a light fixture record corresponding to each light fixture 100. Each floor plan includes a coordinate system that indicates a plurality of light fixtures 100 or fixtures located within the floor plan. Each light fixture record describes a set of light fixture attributes of each light fixture unit 100. In some embodiments, the light fixture attributes include a light fixture identifier of the light fixture 100 and a light fixture location for the light fixture 100. Each light fixture location for each light fixture 100 includes a first set of coordinates that locate the light fixture 100 within the coordinate system of the floor plan. In some embodiments, the light fixture identifier is a serial code of the thermal sensor 15A, infrared sensor grid, or wireless transceiver 14A. In some embodiments, the light fixture identifier can also be the MAC address of the wireless transceiver 14A or a programmable address. In some embodiments, the map library module stores the maps corresponding to different locations within the enclosed environment. For example, it stores maps or floor plans corresponding to but not limited to, retail locations, buildings, hotels, nursing homes or healthcare facilities or shops. Each map or floor plan can be divided into a plurality of sub-regions. A sub-region can describe a predetermined boundary within a retail location. For example, in a supermarket location, a sub-region can refer to a section, for example, a beverage section, a snacks section, etc. In some embodiments, the floor plan of a nursing room can be divided into bathroom, toilets, bedding section or living room section.

In an alternative embodiment of the invention, the map library module 23B includes one or more product records for display on fixtures in the enclosed environment 20. Each product record includes a product identifier and a product location associated with at least one of: (i) a second set of coordinates within the coordinate system of one of the floor plans; and (ii) one of the fixtures located in one of the floor plans. In some embodiments, the map library module includes one or more fixtures or stationary objects in the enclosed environment 20. For example, in a nursing home, the stationary objects are objects that provide a reference to the human activity to be monitored. For example, if the stationary object is a toilet fixture, the human activity monitored may be the lack of activity for a prolonged period of time, which may indicate the likelihood of an incident.

The heat map generation module 23C is configured to generate a heat map for each floor plan through an analysis of the thermal records. In some embodiments, the heat map summarizes the human activity patterns on the floor plan over a predetermined time period. The predetermined time period is configured by an administrator via a user device 24. In some embodiments, a user may submit a query request on the access management application to generate a graphical representation of the human activity pattern of the enclosed environment over a predetermined period of time. The graphical representation can be configured for display on a graphical user interface of a user device. In some embodiments, the graphical representation can be a heat map of a predetermined location over a predetermined time period. In some embodiments, the graphical representation can be correlated to a geographical location of the store, to product within the store. The user device 24 is in data communication with the server 29. In some embodiments, the graphical representation provides feedback to the user on merchandising, analyzing product placement trials, assessing effects of placement, lighting, products, advertising campaigns, graphics, store fixtures. In some embodiments, the analysis includes a moving average convergence divergence (MACD) analysis. In some embodiments, the graphical representation may be in the form of a dashboard display on the access management application. For example, the dashboard may indicate the number of persons passing by a predetermined fixture of interest over a requested time period, the speed of movement of one or more persons around or at a predetermined fixture of interest, or the dwell time of one or more persons around or at a predetermined fixture of interest. The dashboard may also include a breakdown of the aforesaid statistics by time intervals, for example, minutes, hourly, daily, weekly or monthly period.

In some embodiments, the access management application that communicates with the network of light fixtures is configured to send alerts or notifications to the user via the user device for potential emergency scenarios. For example, in a retail location, this could be detection of overcrowding within the enclosed space of the retail location, or in a nursing home, this could be the detection of a prolonged predetermined period of non-activity within a bathroom in a nursing home.

The heat map generation module 23C can generate heat maps for each map stored in the map library module 23B or can generate a heat map upon receiving a request for a heat map for a particular location from a requesting device (e.g., a user device). It should be appreciated that the techniques described herein can be modified to generate heat maps for all of the retail locations in the map library module 23B at defined intervals (e.g., every 15 minutes). In some embodiments, a user may receive alerts remotely through the user device.

A database 23A for storing data including but not limited to historical thermal records can be accessed on the server 29 or the access management application. As used herein, a database may store data to and access data from a single stand-alone computer, a laptop, a tablet, a data server, multiple dedicated data servers, a cloud-based service, and/or a virtual server running on a network of servers. As discussed in the description, the use of the term "database" indicate a collection of tables, records, and/or linkage information for the data records. As depicted in the description and figures, each database can be maintained separately and/or maintained collectively in a single database or through linkages to other database. The databases depicted in the description and figures can be on the same server or on separate servers. Data records can be stored in one database or linked between separate databases.

In some embodiments, the database 23A can be implemented on an Amazon branded web service. In some embodiments, a web service can be used to store thermal records from multiple enclosed environments 20. Such a web service enables economies of scale for a Software as a Service business-to-business platform supporting multiple customers. Customers of the SaaS could, for instance, install preconfigured lamp units 100 at their location and then access heat maps from a user device 24 that is connected to the server 29 or access management application 23. It will be appreciated that a database can include a memory device which are known, and may be used according to the principles of the invention. For example, the database may be a flash memory, read-only memory, or some other non-volatile memory, or the memory may be a random access memory, dynamic random access memory, or some other volatile memory.

Figure 5A:
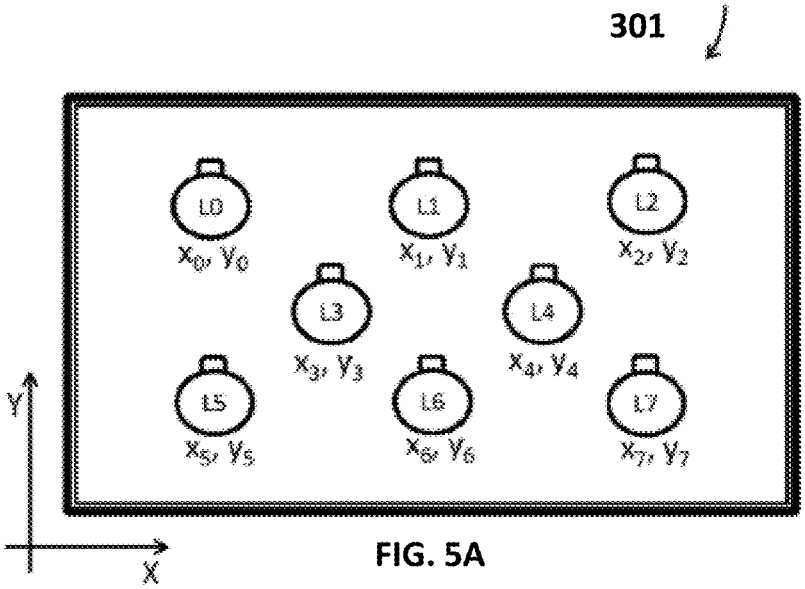
FIG. 5A is an illustration of a floor plan of a retail space overlaid with the placement of light fixtures according to an embodiment of the invention.

FIG. 5A is a first illustration 301 of a floor plan of an enclosed environment 20 overlaid with the placement of lighting fixture L0-L7 according to an embodiment of the invention. In some embodiments, the floor plan has an x-y coordinate system indicating the x-y coordinates (x0, y0 to x7, y7) of the light fixtures (L0-L7, respectively).

Figure 5B:
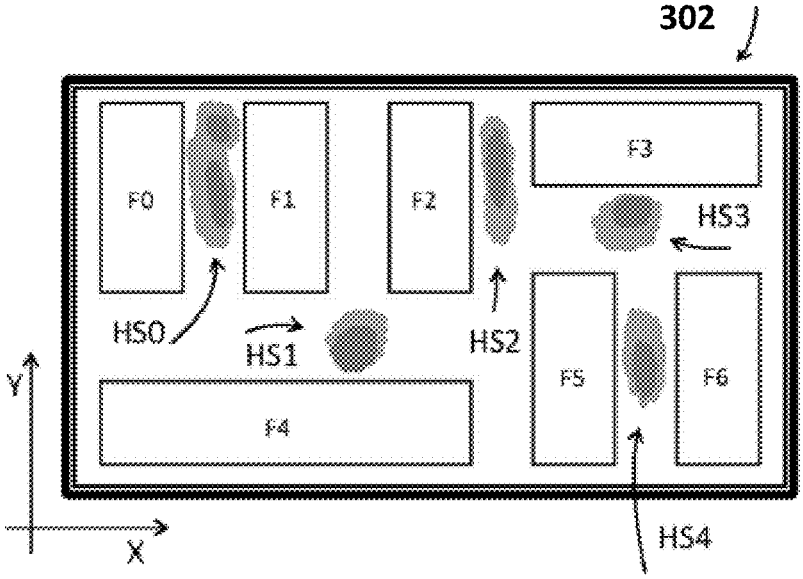
FIG. 5B is an illustration of floor plan of the retail space further including light fixtures and overlaid with a heat map according to an embodiment of the invention.

FIG. 5B is a second illustration 302 of the floor plan of the enclosed environment 20 further including displays F0-F6 and overlaid with heat spot groupings HS0-HS4 in an embodiment of the invention. In some embodiments, each heat spot grouping is represented by 10 shades of a colour, for example gray, red or green, with a darker shading indicating (according to the proxy measurement of customer heat by the thermal sensors 15A) frequency and/or duration of customer presence in each specific location of the enclosed environment 20. Customer interest in product items (not illustrated in FIG. 5B) displayed on the second sample fixtures F0-F6 can be correlated to the shading and/or width of the heat maps. While not illustrated in FIG. 5B, gradations of the heat spot groupings can also be displayed on a user device 24 in full colour.

In some embodiments, a light fixture 100 may determine the number of people which pass by a stationary display or fixture displaying a specific product, the speed at which the people pass the display or fixture, or any other suitable measurement. The data is collected using the processor 14 connected to the thermal sensor 15A by downloading the collected data to a server or access management application for analysis and interpretation, to determine traffic flow, traffic patterns, points of congestion, etc. This analysis may be useful, for example, to determine points where traffic is congested, to help identify a change in the floor layout or display configuration that may help redirect traffic flow or ease passage and congestion, or to determine, for example, how customers prefer to navigate through a supermarket. In other embodiments, such as a retail, supermarket, or department store, such collected data may also be useful to identify customer reactions to displays. For example, a light fixture directed at a display in a retail environment, may collect information such as how long customers view a display on average, whether a display attracts people from distant parts of a store to gauge customer's interest in and reaction to a display, advertisement, or other display meant to attract attention.

In some embodiments, the collected data may further be correlated with information such as sales data or receipts from other inventory systems, to determine the overall effectiveness of retail displays and advertisements. By reviewing and analyzing such data, retailers and marketers can more accurately gauge what types of displays, what locations, and what combinations of items are preferred by customers, are engaging, and are most effective at inducing increased sales. The collected data can also be used to distribute high-interest items throughout a store to achieve even traffic flows, or to increase customer exposure to new or obscure types of merchandise, or items that are typically bought on impulse.

Figure 6:
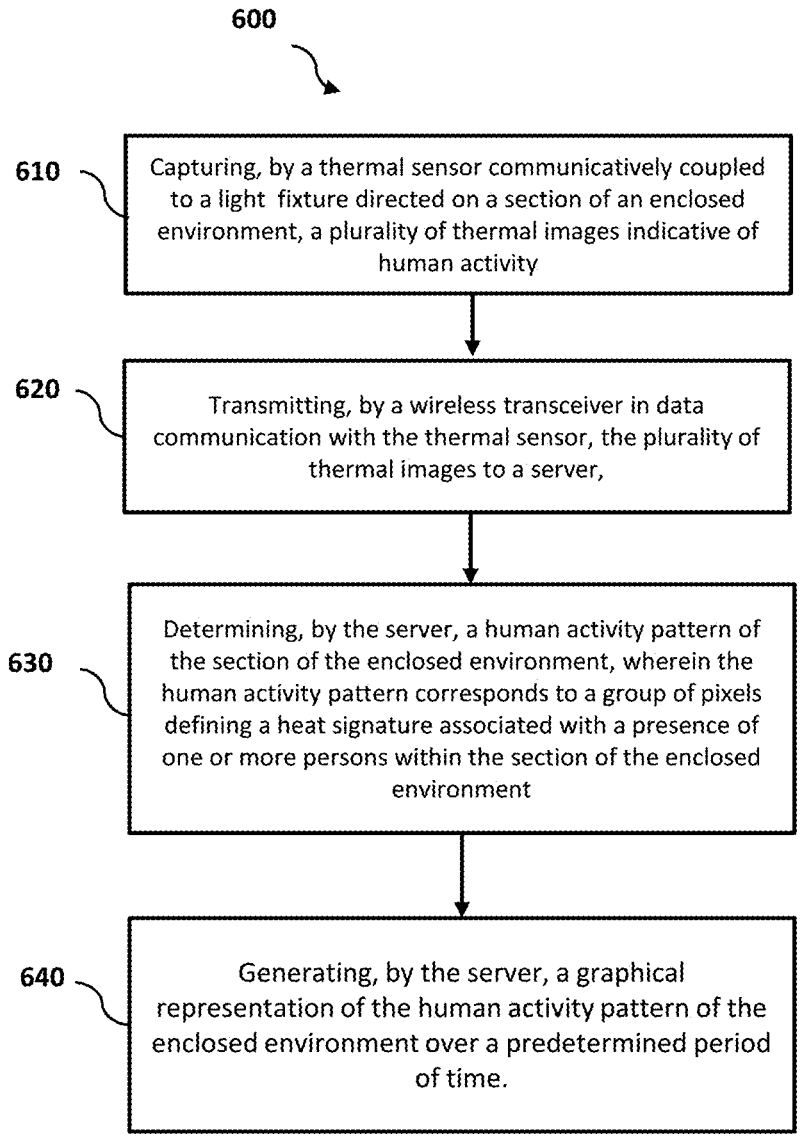
FIG. 6 is a flowchart of an exemplary process for monitoring human activity according to an embodiment of the invention.

FIG. 6 illustrates a flowchart of an exemplary process for monitoring human activity in an enclosed environment according to some embodiments of the invention. In step 610, a thermal sensor communicatively coupled to a light fixture that is substantially directed on a section of the enclosed environment captures a plurality of thermal images indicative of human activity surrounding a fixture within the enclosed environment. Each thermal image includes a grid having a plurality of pixels corresponding to a section of the enclosed environment. In some embodiments, the thermal sensor is capturing images or video of the section of the enclosed environment continuously over a period of time. In some embodiments, multiple light fixtures can be configured such that they are wirelessly connected to one another via a network and may be varied to accommodate the desired needs and situations. For example, multiple light fixtures are configured for installation and wirelessly communicable with one another in the enclosed environment so that the entire enclosed environment can be covered by the light fixtures. This ensures that the thermal sensors have coverage of the entire enclosed environment. In some embodiments, multiple light fixtures are configured for installation and wirelessly communicable with one another in the enclosed environment so that only a section of the enclosed environment is covered by these light fixtures. For example, if a retailer would like to monitor the human activity around a display fixture in a section of the store, light fixtures can be installed around the display fixture so that human activity around the display fixture can be monitored and tracked by the thermal sensors that are communicatively coupled to the light fixtures. In some embodiments, the enclosed environment may include, but not limited to, a retail store, a hotel, a building, an office, a nursing home, a healthcare facility and a hospital.

In step 620, a wireless transceiver 14A communicatively coupled with the thermal sensor within the light fixture transmits the plurality of thermal images to a server. In some embodiments, the wireless transceiver 14A is configured to transmit and receive the thermal images wirelessly via wireless communication protocols, for example, short-range or long-range wireless communication protocols. In some embodiments, the wireless transceiver 14A is intended for transmitting and receiving data for performing functions associated with the light fixture or the thermal sensor. As mentioned above, a server may be implemented within a single stand-alone computer, a stand-alone server, multiple dedicated servers, and/or a virtual server running on a larger network of servers and/or a cloud-based service.

In step 630, the server may determine a human activity pattern of the section of the enclosed environment. In some embodiments, includes an access management application accessible by a user on a user device on a web browser on a computing device or as an application on a mobile computing device. In some embodiments, the server may determine a human activity pattern based on a request received by a user on the user device for a specific region of the enclosed environment. In some embodiments, the access management application includes a map analysis module configured to identify a desired region of the enclosed environment and to analyze the heat signature defined by a group of pixels associated with a presence of one or more persons within the desired region of the enclosed environment. The map analysis module aggregates thermal images obtained from multiple thermal sensors, each of which is coupled to a light fixture, and analyzes the aggregated thermal images for identifying the human activity pattern of the enclosed environment. For example, the human activity pattern detected includes a dwell time of one or more persons. In some embodiments, the non-movement of a group of pixels defining the heat signature over a predetermined time period within the section of the enclosed environment is indicative of the dwell time. In some embodiments, the dwell time of a person can be indicative of a potential emergency situation. For example, in a bathroom, a dwell time of an inordinate amount of time within a bathroom cubicle can indicate a potential life-threatening situation which requires emergency attention. In other embodiments, the human activity pattern includes a navigation pattern of one or more persons. For example, a movement of the heat signature from a group of pixels to a different set of pixels within the grid over a predetermined time period within the section of the enclosed environment is indicative of the directional movement of one or more persons within the enclosed environment. In other embodiments, the human activity pattern includes tracking the speed, velocity and/or acceleration of one or more persons based on how fast or slow the movement of the heat signature from a group of pixels to a different set of pixels within the grid over a predetermined time period.

In some embodiments, the heat signature is obtained by measuring the apparent temperature difference between the ambient temperature and the one or more persons so as to cause the group of pixels to provide a contrast with the plurality of pixels within the grid. In other words, a group of contrasting pixels against all the pixels within the grid is indicative of one or more persons. In some embodiments, due to the downward projection of the light fixture on the enclosed environment, the group of contrasting pixels corresponds to the top view of the head or body mass of one or more persons.

In step 640, the server generates a graphical representation of the human activity pattern of the enclosed environment over a predetermined period of time, wherein the graphical representation is configured for display on a graphical user interface of a user device. The graphical representation may be in the form of a dashboard display on the access management application. For example, the dashboard may indicate the number of persons passing by a predetermined fixture of interest over a requested time period, the speed of movement of one or more persons around or at a predetermined fixture of interest, or the dwell time of one or more persons around or at a predetermined fixture of interest. The dashboard may also include a breakdown of the aforesaid statistics by time intervals, for example, minutes, hourly, daily, weekly or monthly period.

Embodiments of the present invention may be implemented with numerous other general-purpose or special-purpose computing devices and computing system environments or configurations. Examples of well-known computing systems, environments, and configurations that may be suitable for use with an embodiment include, but are not limited to, personal computers, handheld or laptop devices, personal digital assistants, multiprocessor systems, microprocessor-based systems, set top boxes, programmable consumer electronics, network, minicomputers, server computers, game server computers, web server computers, mainframe computers, and distributed computing environments that include any of the above systems or devices. Embodiments may be described in a general context of computer-executable instructions, such as program modules, being executed by a computer.

Generally, program modules include routines, programs, objects, components, data structures, etc., that perform particular tasks or implement particular abstract data types. An embodiment may also be practiced in a distributed computing environment where tasks are performed by remote processing devices that are linked through a communications network. In a distributed computing environment, program modules may be located in both local and remote computer storage media including memory storage devices.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for monitoring human activity within an enclosed environment, the method comprising the steps of: capturing, by a first thermal sensor communicatively coupled to a light fixture substantially directed on a section of the enclosed environment, a plurality of first thermal images indicative of human activity surrounding a fixture within the enclosed environment; transmitting, by a wireless transceiver communicatively coupled with the first thermal sensor, the plurality of the first thermal images to a server, determining, by the server, a human activity pattern of the section of the enclosed environment based on the plurality of the first thermal images, wherein the human activity pattern corresponds to a group of pixels defining a heat signature associated with a presence of one or more persons within the section of the enclosed environment; and generating, by the server, a graphical representation of the human activity pattern of the enclosed environment over a predetermined period of time, wherein the graphical representation is configured for display on a graphical user interface of a user device; aggregating, by the server, a plurality of second thermal images obtained by a second thermal sensor communicatively coupled to a second light fixture with the plurality of first thermal images obtained from the first thermal sensor, wherein the plurality of the first and second thermal images include a grid having a plurality of pixels corresponding to a section of the enclosed environment; determining a potential incident based on the human activity pattern associated with a movement or a lack of movement of one or more persons over a predetermined period of time and the enclosed environment; and transmitting, by an access management application, an alert notification to the user device when the server determines the occurrence of the potential incident based on the human activity pattern and the enclosed environment.

2. The method according to claim 1, wherein the enclosed environment includes any one selected from the group consisting of: a retail store, a hotel, a building, an office, a nursing home, a healthcare facility and a hospital.

3. The method according to claim 1, wherein the heat signature is obtained by measuring the apparent temperature difference between the ambient temperature and the one or more persons so as to cause the group of pixels to provide a contrast with the plurality of pixels within the grid.

4. The method according to claim 1, wherein the group of pixels defining the heat signature corresponds to a top view of the head of one or more persons.

5. The method according to claim 1, wherein the group of pixels defining the heat signature corresponds to a top view of the body mass of one or more persons.

6. The method according to claim 1, wherein the human activity pattern further includes a dwell time of the one or more persons, wherein the dwell time is based on the non-movement of the group of pixels defining the heat signature over a predetermined time period within the section of the enclosed environment.

7. The method according to claim 1, wherein the human activity pattern further includes a navigation pattern of the one or more persons, wherein the navigation pattern is based on a movement of the heat signature from the group of pixels to a second group of pixels over a predetermined time period within the section of the enclosed environment.

8. The method according to claim 1, wherein the grid further includes a coordinate system for identifying the group of pixels within the enclosed environment, wherein the coordinate system includes an x-coordinate axis and a y-coordinate axis, each of which is configured to locate the heat signature of the group of pixels.

9. A light fixture for monitoring human activity within an enclosed environment, the light fixture comprising: a light fixture housing for housing a lighting element configured for projecting light downwards on a section of the enclosed environment, a thermal sensor housed within a sensor housing coupled to the light fixture housing, the thermal sensor configured to capture a plurality of thermal images indicative of human activity surrounding a fixture within the enclosed environment, wherein each thermal image includes a grid having a plurality of pixels corresponding to a section of the enclosed environment; a processor configured to receive the plurality of thermal images from the thermal sensor, wherein the processor is in data communication with the thermal sensor and the light fixture; a wireless transceiver communicatively coupled to the processor and configured to transmit the plurality of thermal images to a server, wherein the server includes: at least one non-transitory memory including computer program code; the at least one non-transitory memory and the computer program code configured to, with the processor, cause the server at least to: determine a human activity pattern of the section of the enclosed environment, and the human activity pattern corresponds to a group of pixels defining a heat signature associated with a presence of one or more persons within the section of the enclosed environment; generate a graphical representation of the human activity pattern of the enclosed environment over a predetermined period of time, wherein the graphical representation is configured for display on a graphical user interface of a user device; aggregate a plurality of thermal images obtained by a the thermal sensor communicatively coupled to a first and a second light fixture respectively, wherein the plurality of thermal images include a grid having a plurality of pixels corresponding to a section of the enclosed environment; determine a potential incident based on the human activity pattern associated with a movement or a lack of movement of one or more persons over a predetermined period of time and the enclosed environment; and transmit, by an access management application, an alert notification to the user device when the human activity pattern and the enclosed environment indicates an occurrence of the potential incident.

10. The light fixture according to claim 9, further comprising a power source electrically connected to the thermal sensor, wherein the power source is configured to provide power supply to the thermal sensor when the power to the light fixture is turned off.

11. The light fixture according to claim 9, wherein the enclosed environment includes any one selected from the group consisting of: a retail store, a hotel, a building, an office, a nursing home, a healthcare facility and a hospital.

12. The light fixture according to claim 9, wherein the heat signature is obtained by measuring the apparent temperature difference between the ambient temperature and the one or more persons so as to cause the group of pixels to provide a contrast with the plurality of pixels within the grid.

13. The light fixture according to claim 9, wherein the group of pixels defining the heat signature corresponds to a top view of the head of one or more persons.

14. The light fixture according to claim 9, wherein the human activity pattern further includes a dwell time of the one or more persons, wherein the dwell time is based on the non-movement of the group of pixels defining the heat signature over a predetermined time period within the section of the enclosed environment.

15. The light fixture according to claim 9, wherein the human activity pattern further includes a navigation pattern of the one or more persons, wherein the navigation pattern is based on a movement of the heat signature from the group of pixels to a second group of pixels over a predetermined time period within the section of the enclosed environment.

16. The light fixture according to claim 9, wherein the grid further includes a coordinate system for identifying the group of pixels within the enclosed environment, wherein the coordinate system includes an x-coordinate axis and a y-coordinate axis, each of which is configured to locate the heat signature of the group of pixels.

17. A lighting system for monitoring human activity within an enclosed environment, comprising: a server configured for wireless communication with the plurality of light fixtures, wherein the server is configured to determine a human activity pattern within the enclosed environment, and the human activity pattern corresponds to a group of pixels defining a heat signature associated with a presence of one or more persons within the enclosed environment; and a plurality of light fixtures mounted within the enclosed environment and configured for wireless connection with one another and to the server via a network, wherein each light fixture comprises: a thermal sensor housed within a sensor housing coupled to the light fixture, wherein the thermal sensor is communicatively coupled to the light fixture and configured to capture a plurality of thermal images indicative of human activity surrounding a fixture within the enclosed environment, wherein each thermal image includes a grid having a plurality of pixels corresponding to a section of the enclosed environment; a processor configured to receive the plurality of thermal images from the thermal sensor, wherein the processor is in data communication with the thermal sensor and the light fixture; a wireless transceiver communicatively coupled to the processor, at least one non-transitory memory including computer program code; the at least one memory and the computer program code configured to, with the processor, cause the server at least to: determine a human activity pattern of the section of the enclosed environment, and the human activity pattern corresponds to a group of pixels defining a heat signature associated with a presence of one or more persons within the section of the enclosed environment; generate a graphical representation of the human activity pattern of the enclosed environment over a predetermined period of time, wherein the graphical representation is configured for display on a graphical user interface of a user device; aggregate the plurality thermal images obtained by the thermal sensor communicatively coupled to a first and a second light fixture respectively, wherein the plurality of thermal images include a grid having a plurality of pixels corresponding to a section of the enclosed environment; determine a potential incident based on the human activity pattern associated with a movement or a lack of movement of one or more persons over a predetermined period of time and the enclosed environment; and transmit, by an access management application, an alert notification to the user device when the human activity pattern and the enclosed environment indicates an occurrence of the potential incident.

* * * * *